US010881218B2

(12) United States Patent
Mascull

(10) Patent No.: US 10,881,218 B2
(45) Date of Patent: Jan. 5, 2021

(54) OVERLAY CUSHION WITH REMOVABLE CONTOURING MEMBERS

(71) Applicant: Elizabeth Jocelyn Mascull, Ashburton (NZ)

(72) Inventor: Roger Thomas Mascull, Ashburton (NZ)

(73) Assignee: Roger Thomas Mascull and Elizabeth Jocelyn Mascuall, Rolleston (NZ), as Trustees of the RT and EJ Family Trust ( * ) Notice: Subject to any disclaimer, the term of this patent is extended or adjusted under 35 U.S.C. 154(b) by 257 days.

(21) Appl. No.: 15/764,191

(22) PCT Filed: Sep. 26, 2016

(86) PCT No.: PCT/NZ2016/050158

§ 371 (c)(1),
(2) Date: Mar. 28, 2018

(87) PCT Pub. No.: WO2017/058030

PCT Pub. Date: Apr. 6, 2017

(65) Prior Publication Data

US 2018/0317665 A1 Nov. 8, 2018

(30) Foreign Application Priority Data

Sep. 30, 2015 (AU) ..... 2015903973

(51) Int. Cl.
*A47C 27/14* (2006.01)
*A47C 27/15* (2006.01)
(Continued)

(52) U.S. Cl.
CPC ..... *A47C 27/146* (2013.01); *A47C 7/36* (2013.01); *A47C 7/425* (2013.01); *A47C 27/148* (2013.01);
(Continued)

(58) Field of Classification Search
CPC ..... A47C 27/146; A47C 7/36; A47C 27/148; A47C 7/425; A47C 27/15; A61G 5/1048;
(Continued)

(56) References Cited

U.S. PATENT DOCUMENTS 2,785,739 A * 3/1957 McGregor, Jr. ..... A47C 27/146 267/145
3,512,190 A * 5/1970 Buff ..... A47C 27/15 5/730

(Continued)

FOREIGN PATENT DOCUMENTS

EP 0114762 A2 8/1984
FR 2539297 7/1984

(Continued)

OTHER PUBLICATIONS

European Search Report for EP Application No. 16852155 dated Apr. 15, 2019 (8 pages).

(Continued)

*Primary Examiner* — Myles A Throop
(74) *Attorney, Agent, or Firm* — Merchant & Gould P.C.

(57) ABSTRACT

The invention provides an overlay configured to substantially conform to a contoured surface. The overlay comprises at least a first layer having a rear surface on which a plurality of channels are located. Optionally, the overlay also comprises one or more removable contouring members, which are located between adjacent channels on the rear surface of the overlay.

13 Claims, 13 Drawing Sheets

(51) Int. Cl.

| | |
|---|---|
| ***A61G 7/057*** | (2006.01) |
| ***A61G 5/10*** | (2006.01) |
| ***A47C 7/36*** | (2006.01) |
| ***A47C 7/42*** | (2006.01) |
| ***A61G 7/07*** | (2006.01) |

(52) U.S. Cl.
CPC ..... *A47C 27/15* (2013.01); *A61G 5/1048* (2016.11); *A61G 7/05715* (2013.01); *A61G 7/05723* (2013.01); *A61G 5/1045* (2016.11); *A61G 7/07* (2013.01)

(58) Field of Classification Search
CPC .. A61G 7/05723; A61G 7/05715; A61G 7/07; A61G 5/1045
USPC ..... 5/653, 655.9
See application file for complete search history.

(56) References Cited

U.S. PATENT DOCUMENTS

| | | | | |
|---|---|---|---|---|
| 3,828,378 | A * | 8/1974 | Flam | A61G 7/05707 5/730 |
| 4,768,251 | A * | 9/1988 | Baskent | A47C 27/146 5/722 |
| 4,847,933 | A * | 7/1989 | Bedford | A61G 5/1043 5/652.2 |
| 4,862,538 | A * | 9/1989 | Spann | A61G 7/05707 5/730 |
| 5,101,527 | A | 4/1992 | Wadsworth, III et al. | |
| 5,459,896 | A * | 10/1995 | Raburn | A47C 7/021 5/653 |
| 5,737,788 | A | 4/1998 | Castellino et al. | |
| 2008/0201860 | A1 * | 8/2008 | Malzl | A47C 27/001 5/727 |
| 2009/0126107 | A1 | 5/2009 | Kuo | |

FOREIGN PATENT DOCUMENTS

| | | |
|---|---|---|
| FR | 2703586 | 10/1994 |
| GB | 1518845 | 7/1978 |
| GB | 2492125 | 12/2012 |
| WO | 2014038961 A1 | 3/2014 |
| WO | 2015091355 A1 | 6/2015 |

OTHER PUBLICATIONS

International Search Report for International Application No. PCT/NZ2016/050158 dated Dec. 2, 2016.

* cited by examiner

OVERLAY CUSHION WITH REMOVABLE CONTOURING MEMBERS

This application is a National Stage Application of PCT/NZ2016/050158, filed 26 Sep. 2016, which claims benefit of Serial No. 2015903973, filed 30 Sep. 2015 in Australia and which applications are incorporated herein by reference. To the extent appropriate, a claim of priority is made to each of the above disclosed applications.

FIELD OF INVENTION

This invention relates to an overlay, which is configured to substantially conform to the contours of a support surface, such as a mattress or seat.

BACKGROUND

Seating users, and in particular, wheelchair users may be required to be seated for extended periods. It is important that in a seat, such as a wheelchair, the wheelchair seating provides sufficient padding for comfort and to assist in preventing injuries associated with being seated for long periods. It is also helpful if wheelchair seating can be customised to meet the requirements of individual wheelchair users, especially high needs users of wheelchairs who may also require contoured seating to assist with their positioning in a wheelchair. For example, asymmetric seating may be necessary to encourage some users to sit as comfortably upright as possible.

It is known to provide contoured seats for wheelchairs. However, such seats are typically manufactured on a case by case basis, meaning that each seat is made for the individual needs of its user. The resulting seat is labour intensive and is typically expensive as a result. Another drawback of bespoke manufacturing of wheelchair seats is that the user's needs can change over time as a result of growth (especially in the case of a child) or as a result of a change in posture. This means, that the user then requires another wheelchair seat to be made especially for their needs and must wait while the seat is being manufactured.

Known cushioning overlays allow a user to attach contouring pads to a flat surface of the cushioning overlay, but it can be difficult for a user to determine where to position the pads. In some cases, the cells may be prone to move sideways over time if the cells are subjected to ongoing lateral pressure. Often, the contouring provided by these systems is insufficiently flexible to provide the user with a comfortable contoured cushion devoid of pressure points.

Another drawback with known contouring overlays is that the overlay does not breathe well and therefore may cause the user to sweat more than desired, or in any case there is an impediment to the natural evaporation of any degree of sweating, and resultant moisture entrapment.

It is an object of a preferred embodiment of the present invention to go at least some way towards addressing the above needs or to at least provide a useful alternative to known cushioning overlays.

SUMMARY OF INVENTION

In one form, the invention provides an overlay comprising a first layer having front surface and a rear surface, wherein a plurality of channels are provided on the rear surface and extend in a first direction along the rear surface, wherein one or more removable contouring members are located between adjacent channels and project from a body of the first layer, wherein the body forms a supporting substrate for the removable contouring members.

In one form, the rear surface of the first layer further comprises a plurality of channels extending in a second direction along the rear surface. Preferably, the second direction is substantially orthogonal to the first direction to provide removable contouring members in a grid-like arrangement. Preferably, each channel is formed in a straight line. Preferably, the channels are of equivalent depth.

Preferably, the removable contouring members have a substantially square or rectangular shape.

In one form, at least two removable contouring members are located between adjacent channels and are stacked one upon the other.

In one form, the first layer, including the body and removable contouring members, is formed as a single part. Preferably, the first layer is formed of foam.

In one form, separation lines are provided between stacked removable contouring members and are configured to allow the removable contouring members to be torn or cut away from each other.

Preferably, the separation lines are provided between the body of the first layer and adjacent removable contouring members to allow the removable contouring members to be torn or cut away from the body of the first layer.

The separation lines are optionally formed by perforations through the material of the first layer.

In one form, a second layer is attached to the front surface of the first layer.

Optionally, the second layer is formed of a different material to the first layer.

In one form, the first and second layers are both foam layers and the first foam layer has different compressibility characteristics to the second foam layer.

In one form, the second layer comprises one or more areas having different compressibility characteristics to one or more other areas of the second layer.

Additionally or alternatively, the first layer comprises one or more areas having different compressibility characteristics to one or more other areas of the first layer.

Preferably, the first layer comprises a plurality of breathing holes for breathability.

In one form, both the first and second layers comprise a plurality of substantially aligned breathing holes extending between the first and second layers.

Preferably, the substantially aligned breathing holes are provided in a substantially regular arrangement.

Optionally, the substantially regular arrangement of breathing holes is configured to correspond with a substantially regular arrangement of breathing holes provided on a backrest against which the overlay may be positioned.

In one form, at least one breathing hole extends through at least one removable contouring member provided on the rear surface of the first layer of the overlay.

The term "comprising" and derivatives thereof, such as "comprise" and "comprises", if and when used herein in relation to a combination of features should not be taken as excluding the possibility that the combination may have further unspecified features. For example, a statement that an arrangement "comprises" certain parts does not mean that it cannot also, optionally, have additional parts. In other words, the terms "comprises", "comprising", and similar words, are not to be interpreted in an exclusive or exhaustive sense. Instead, they are intended to mean "including, but not limited to.

Any reference to prior art documents in this specification is not to be considered an admission that such prior art is widely known or forms part of the common general knowledge in the field.

BRIEF DESCRIPTION OF THE DRAWINGS

Preferred forms of the invention will now be described by way of example and with reference to the accompanying drawings, in which.

DETAILED DESCRIPTION

The invention is further described with reference to the following examples. It will be appreciated that the invention as claimed is not intended to be limited in any way by these examples.

The invention comprises an overlay 500 that is configured to substantially conform around a contoured surface.

Figure 1:
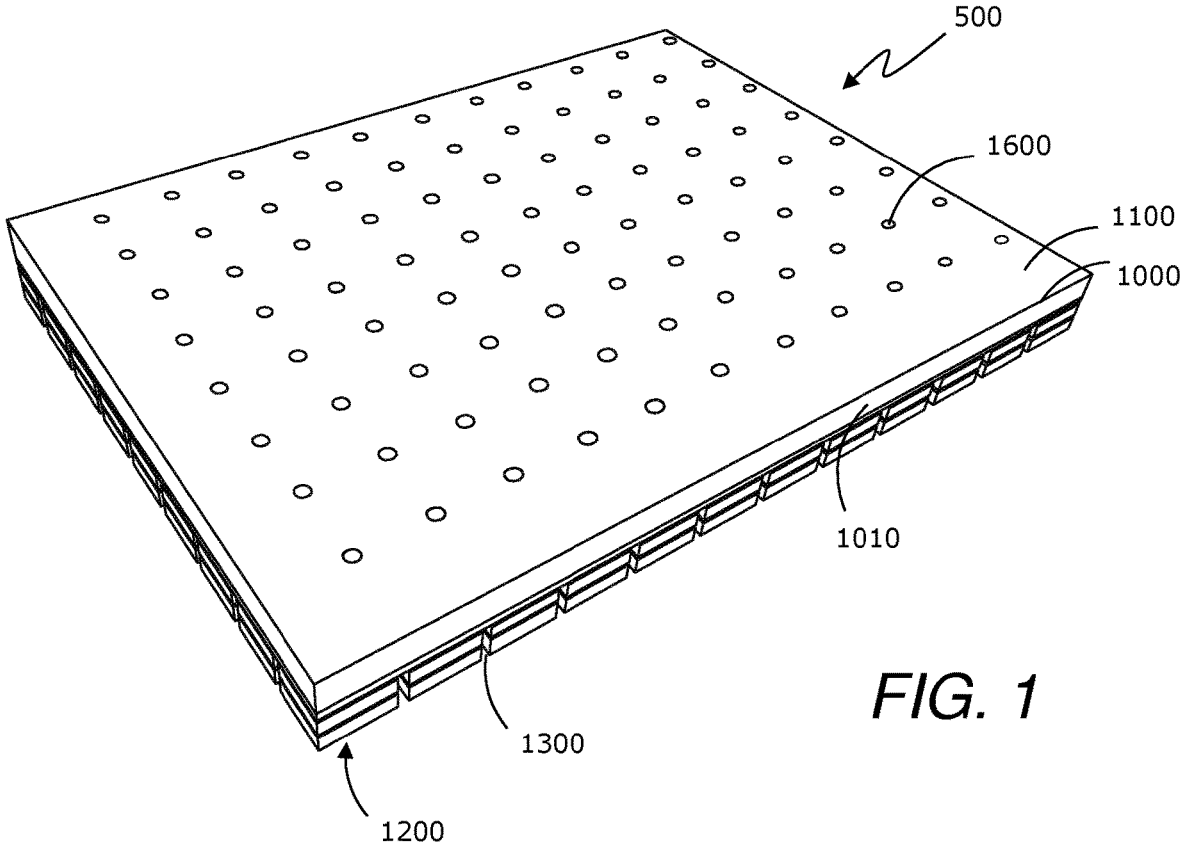
FIG. 1 is a front view of one form of overlay of the invention.

Referring to FIG. 1, in one form, the overlay 500 comprises a first layer 1000 having a front surface 1100 and an opposing rear surface 1200. The first layer comprises a body 1010 forming a supporting substrate having a first surface from which a plurality of removable contouring members 1400 may project. A plurality of channels 1300 are formed on the rear surface 1200 of the overlay and extend in a first direction along the rear surface 1200. The channels 1300 may extend laterally, horizontally, diagonally, or at any desired direction along the rear surface. Preferably, the channels are of equal depth. The deepest point of each channel may lie in the same plane as the first surface of the body 1010 of the first layer 1000. Regions of the overlay 500 that lie between the channels 1300 form contouring members 1400. The region beneath the channels forms the body/supporting substrate 1010 of the first layer 1000.

Figure 2:
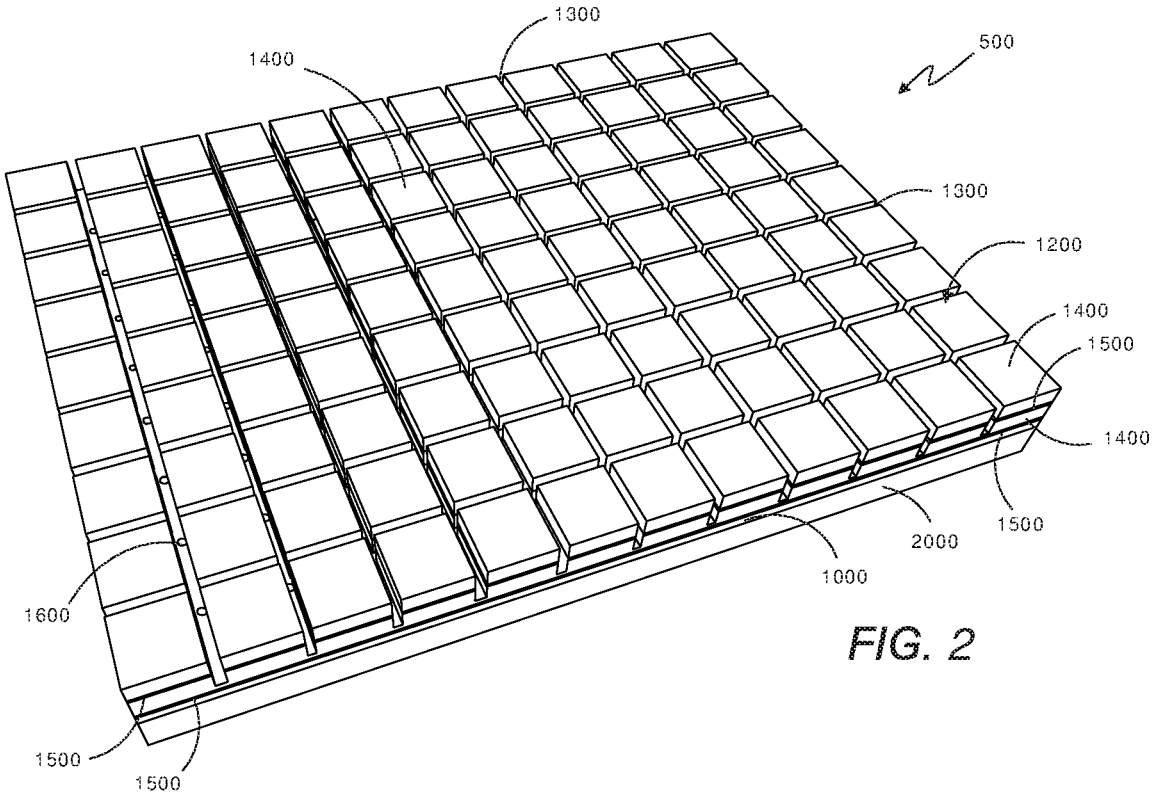
FIG. 2 is a rear view of one form of overlay of the invention.
Figure 3:
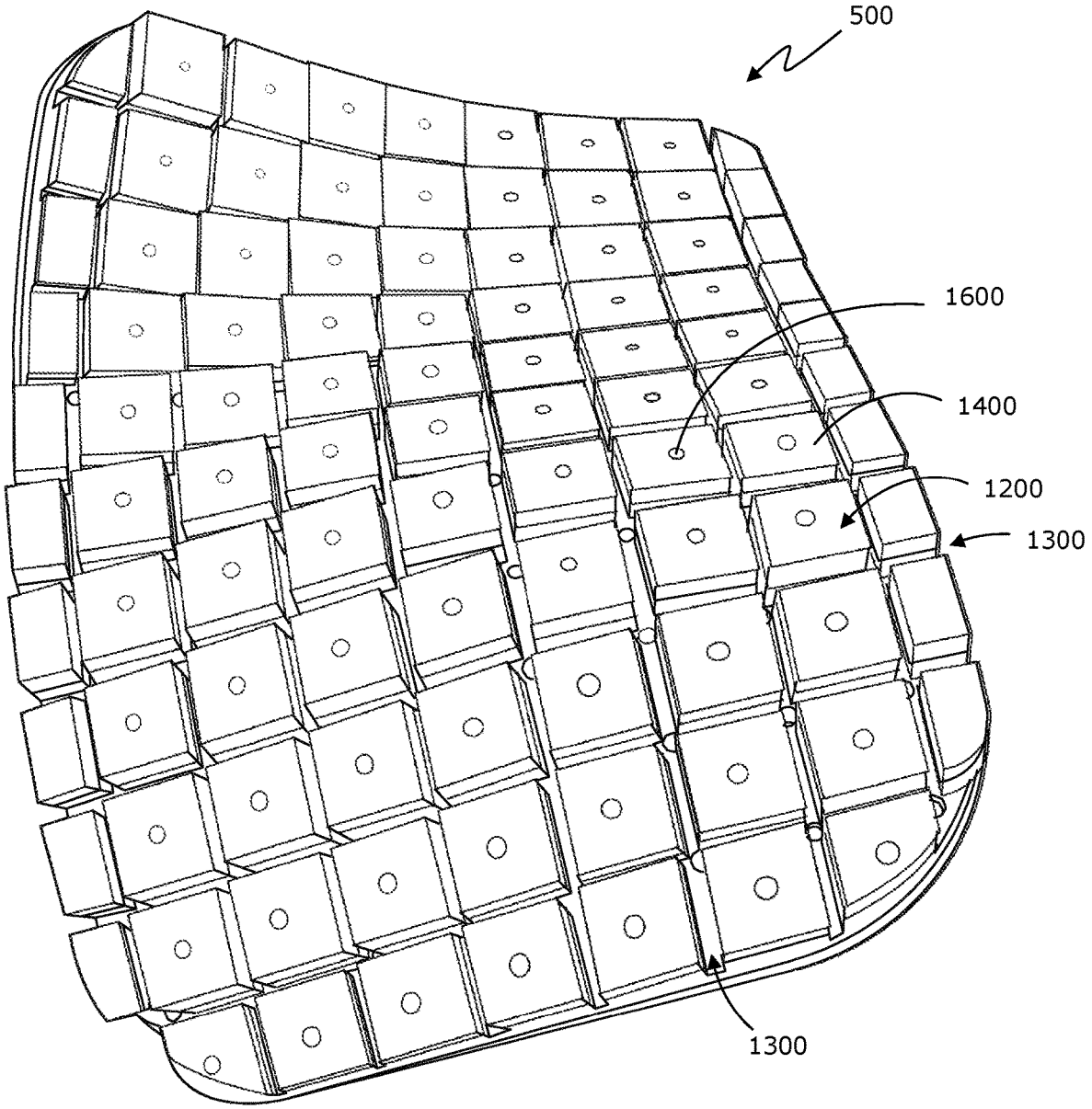
FIG. 3 is a rear perspective view of the overlay of FIG. 2 when curved around a contoured surface.
Figure 4:
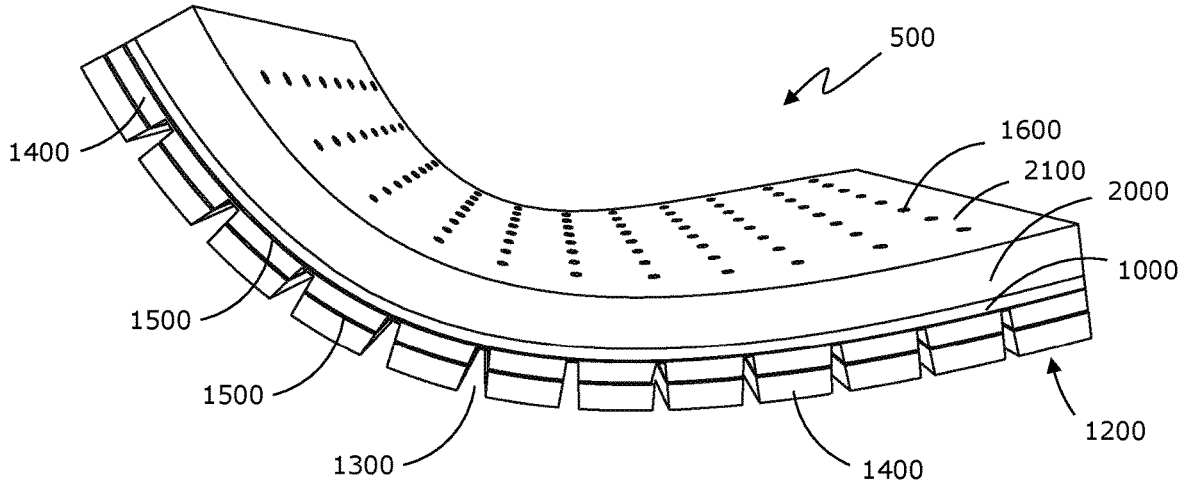
FIG. 4 is a perspective view of one form of overlay of the invention where separation lines can be seen.

In one form, the rear surface 1200 of the overlay 500 also comprises a plurality of channels 1300 that extend in a second direction along the rear surface, as shown in FIG. 2. The second direction may be at any angle between 0-180° relative to the first direction. In one form, the second direction is substantially orthogonal to the first direction so that the channels extending in the first and second directions bisect each other to form a grid-like arrangement. In this form, a plurality of square or rectangular shapes are formed between the channels 1300 on the rear surface of the overlay, as shown in FIG. 3, and comprise contouring members.

In one form, the channels 1300 may be formed in the first layer 1000 when the first layer is manufactured. For example, the first layer may be formed from a moulded material in which the channels are provided during the moulding process. In another form, the channels 1300 may be cut into the rear of the first layer or may be otherwise formed in the first layer 1000.

In another form, the first layer 1000 may be built up to provide channels 1300 and contouring members 1400 between the channels 1300 by attaching the shaped contouring members 1400 to a layer of material that forms the body 1010 of the first layer 1000. The body may be formed of foam, rubber, silicone, or any other suitable material. The contouring members 1400 may be the same material as the body 1010 of the first layer or they may be formed form a different material.

The contouring members 1400 may be attached to the body 1010 of the first layer in any desired arrangement, such as a grid-like arrangement, so that a channel 1300 is provided between adjacent contouring members. The contouring members 1400 may be attached to the first layer 1000 by welding, bonding or adhering the contouring members 1400 to the body 1010 of the first layer 1000, or by the use of corresponding hook and loop fasteners that may be applied to at least one surface of a contouring member 1400 and to the first surface of the body 1010 of the first layer to which the contouring member 1400 will be attached. The contouring members 1400 may be adhered to the first surface of the body 1010 of the first layer using a light application of glue or a suitable adhesive that allows the contouring members to be peeled off and repositioned on the body/supporting substrate. In each of the configurations where the contouring members 1400 are adhered or attached to the first surface of the body 1010 of the first layer 1000 using hook and loop fasteners, the contouring members 1400 can be peeled away from the body 1010 of the first layer 1000 and repositioned, if necessary.

The channels 1300 may be of any suitable width and depth, provided that the channels 1300 are not so wide or deep as to damage the structural integrity of the first layer 1000, which would make the overlay 500 vulnerable to shear forces that could cause the overlay 500 to tear or otherwise break.

In one form, each channel 1300 is in the form of a substantially straight line. However, in other forms, one or more channels 1300 may be curved or angled to achieve the desired contouring effect of the overlay and/or to produce contouring members of desired shapes between adjacent channels.

The overlay 500 is formed of a flexible or semi-flexible material that becomes more flexible after the channels 130 are provided on the rear surface 1200. The channels 1300 assist the overlay to substantially conform around a contoured surface, as shown in FIG. 3.

The first layer 1000 of the overlay 1 may be formed of foam, rubber, silicone or any other suitably conforming material. In one form, the overlay 500 comprises a compressible material on its front surface 1100 to support the comfort of the user. The front surface of the overlay may be soft to provide cushioning characteristics.

The rear surface 1200 of the first layer 1000 may be configured to provide one or more removable contouring members 1400 between adjacent channels 1300. For example, where the channels 1300 form a grid-like arrangement, the square or rectangular contouring members between the channels may be configured to be removable so as to form removable contouring members 1400. Similarly, where the channels form a lattice arrangement that provides diamond shapes between adjacent channels, the diamond shapes may be configured to be removable so as to form removable contouring members.

Separation lines 1500 may be provided on the rear surface 1200 of the first layer 1000 to define a line of separation along which the removable contouring members 1400 can be removed from the body 1010 of the first layer 1000, as shown in FIGS. 4 to 7. In one form, the separation lines 1500 may be perforation lines in the form of a series of holes or slots or the like that are provided between the removable contouring members 1400 and the body of the first layer 1000. Preferably, the separation lines are provided along a plane that lies substantially parallel to the plane of the front and/or rear surface of the first layer.

The removable contouring members 1400 may therefore be removed from the rear surface 1200 of the first layer 1000 by tearing, peeling, cutting or otherwise separating the contouring members 1400 along the separation lines 1500. The thickness of the first layer is therefore reduced in areas where a removable contouring member has been removed. Optionally, the separation lines may lie along the first surface of the body and between the body and removable contouring members.

In one form, the first layer 1000 may be configured so that two or more removable contouring members 1400 are stacked one on top of the other between adjacent channels 1300, as shown in FIGS. 2 to 7. In this form, separation lines 1500 may be located between each stacked contouring member 1400. Separation lines 1500 may also be provided between the body 1700 of the first layer 1000 and the removable contouring members 1400, as shown in FIGS. 2 to 7, to allow for ease of removal of individual contouring members 1400.

Figure 8:
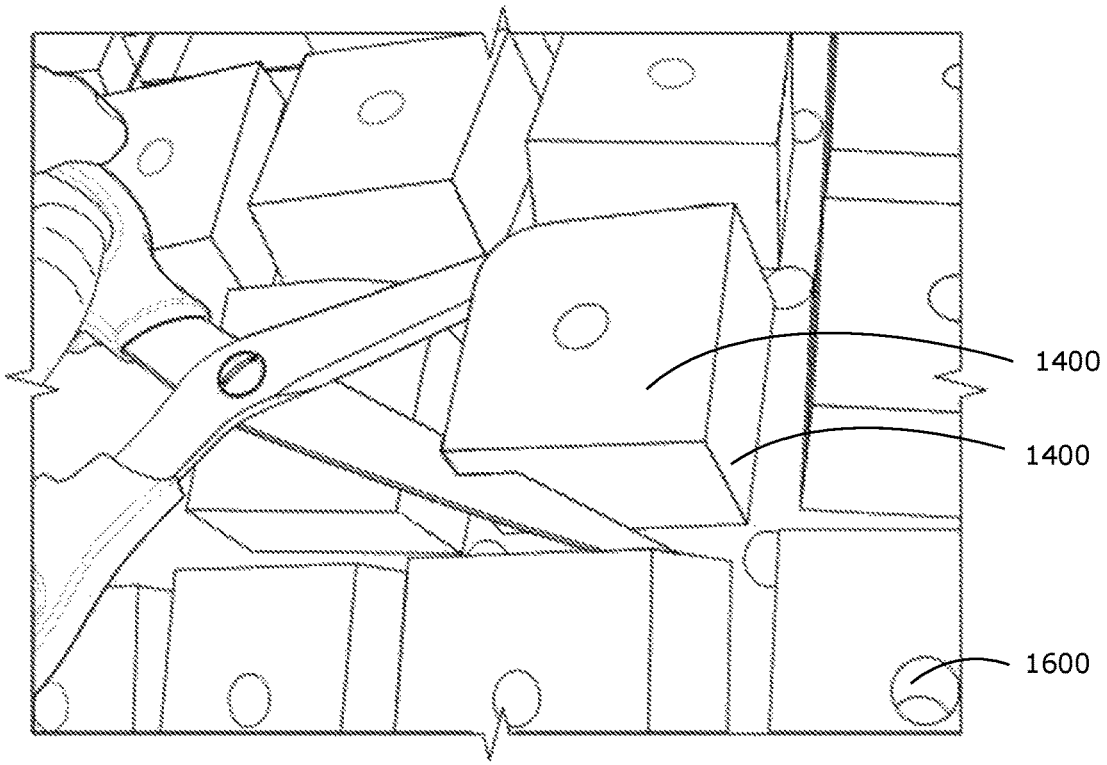
FIG. 8 is a close up view of the rear of the overlay of FIG. 4 where one removable contouring member is being trimmed away from the adjacent removable contouring member with a cutting tool.

In another form, the first layer 1000 of the overlay is not provided with separation lines 1500. In this form, the removable contouring members 1400 may be cut away from the first layer 1000 with a cutting tool, such as scissors, a knife, or other sharp instrument, as shown in FIG. 8. In some forms, the first layer 1000 may be made of a material, such as a suitable type of foam, which allows for the removable contouring members 1400 to be easily torn or peeled away from the body of the first layer even when separation lines are not present.

Figure 9:
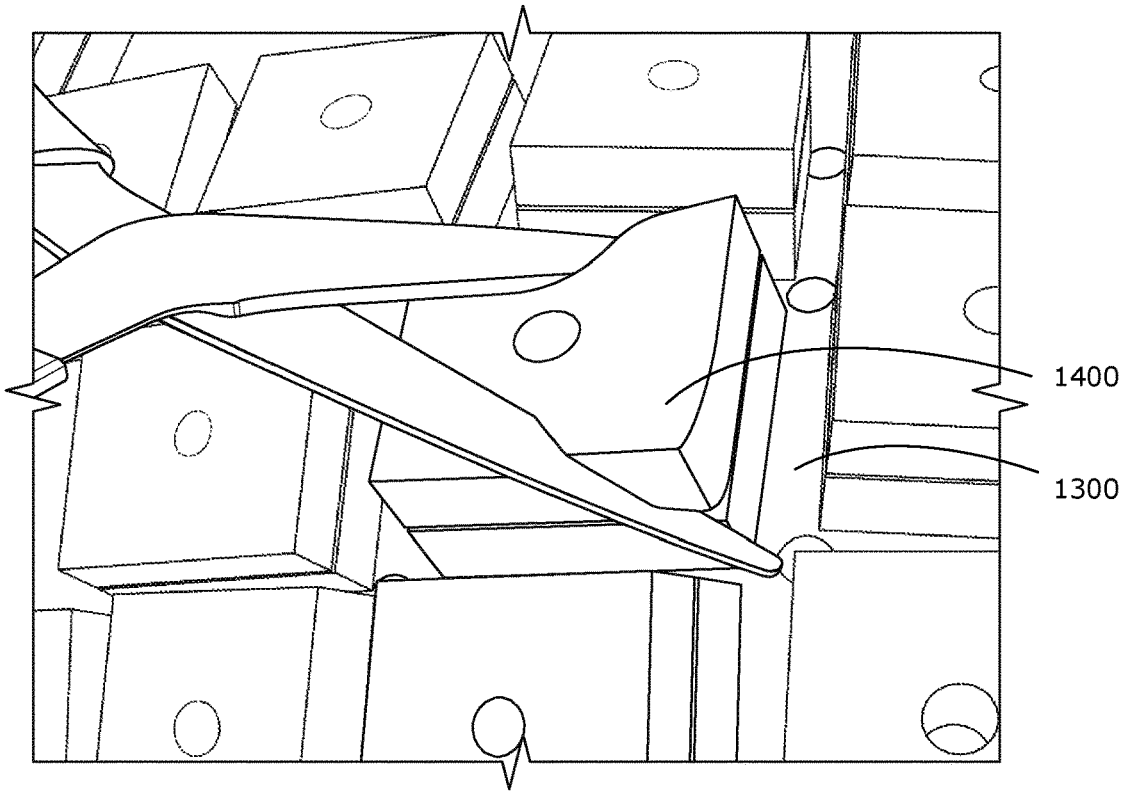
FIG. 9 is a close up view of the rear of the overlay of FIG. 4 where two stacked removable contouring members are being trimmed at an angle.
Figure 10:
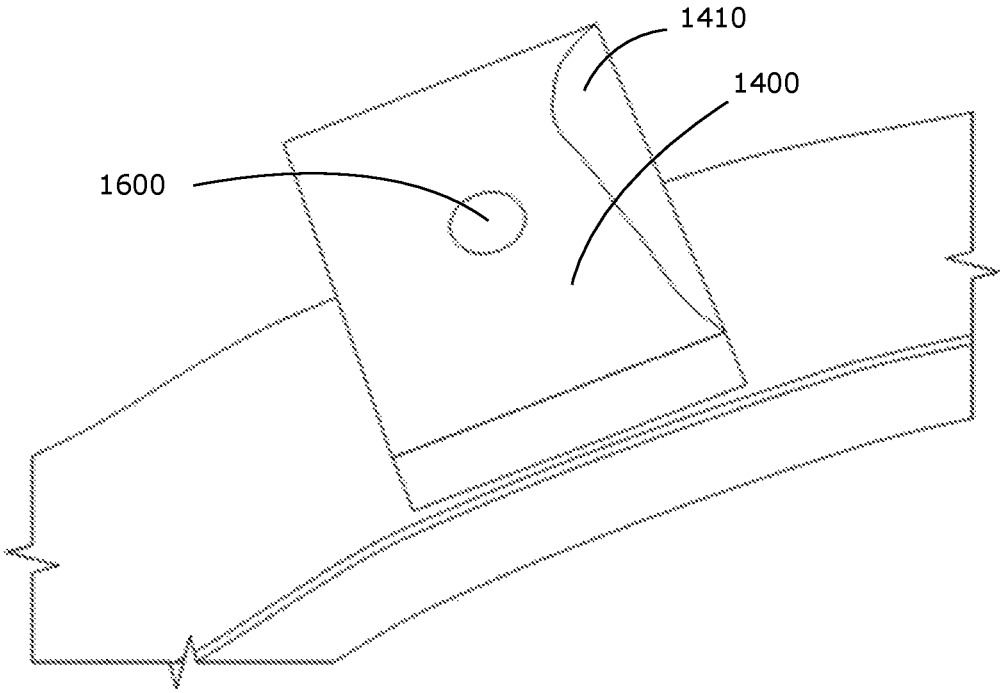
FIG. 10 is a close up view showing a removable contouring member that has been trimmed at an angle.
Figure 11:
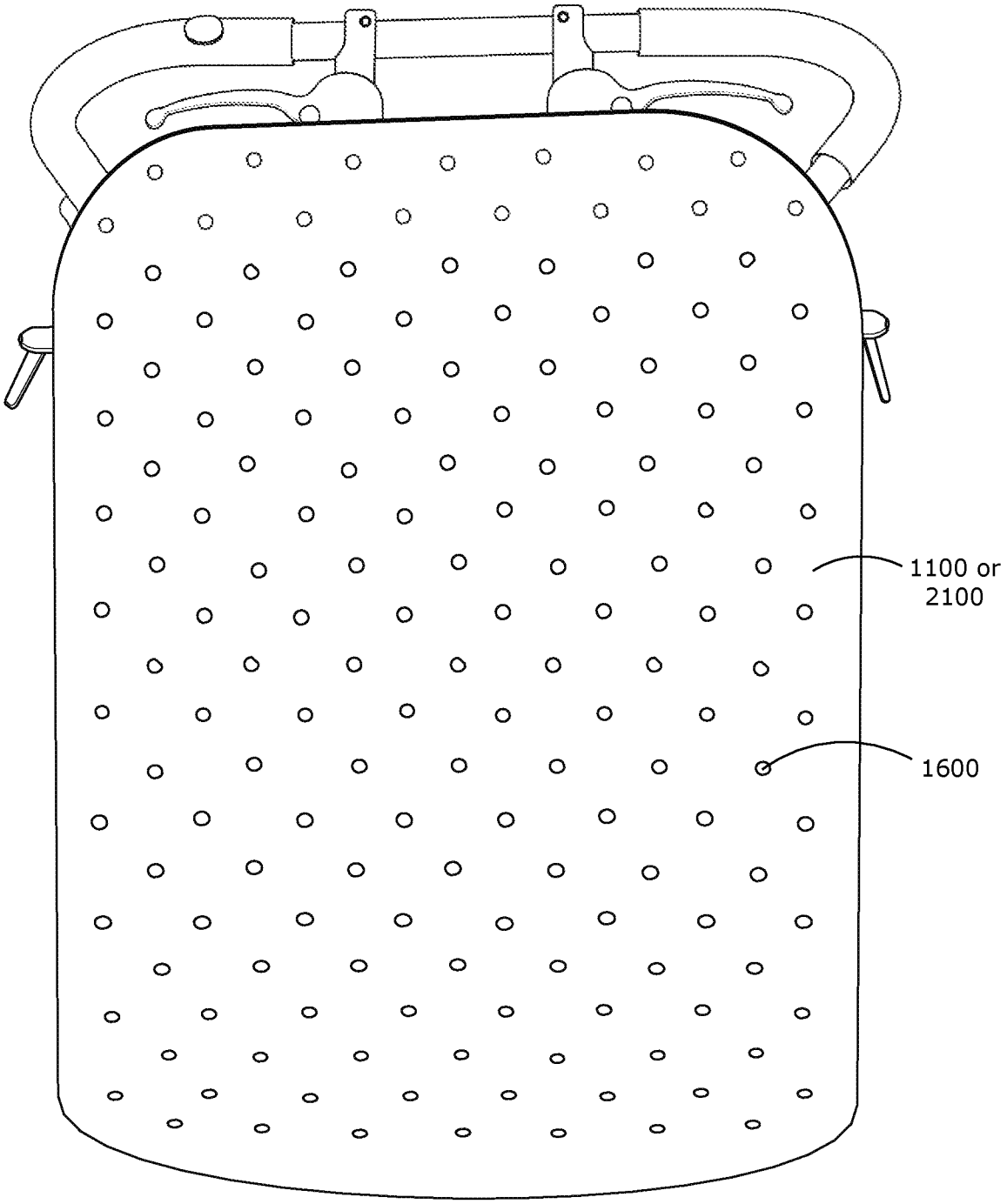
FIG. 11 is a front view of one form of overlay of the invention that has been placed over the backrest of a wheelchair.

In some forms, the removable contouring members 1400 may be trimmed to a desired shape, instead of being removed. For example, angles may be cut in one or more contouring members 1400, as shown in FIGS. 9 and 10, to provide an angled surface 1410. Optionally, the removable contouring members 1400 may be provided with one or more angled separation lines 1500 to allow the contouring members 1400 to be easily angled by tearing or cutting along one or more angled separation lines 1500.

Figure 5:
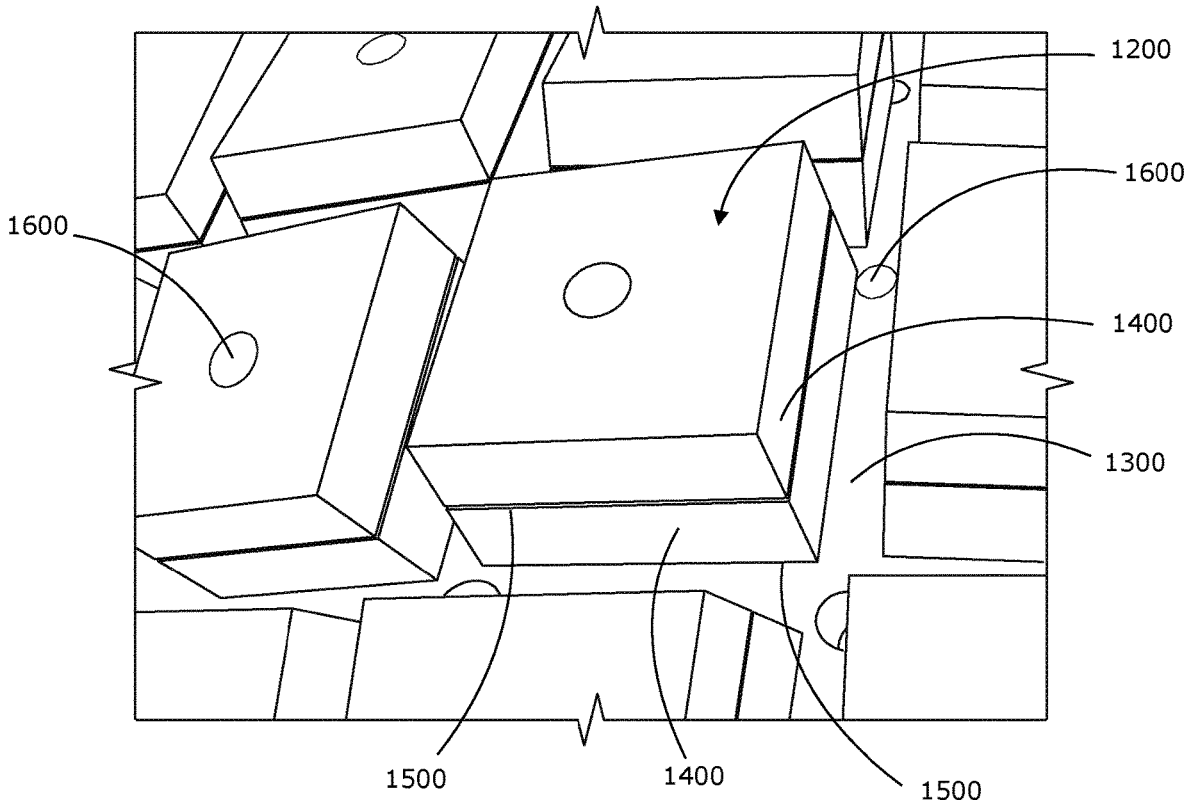
FIG. 5 is a close up view of the rear of the overlay, showing the stacked removable contouring members according to one form of the invention.
Figure 6:
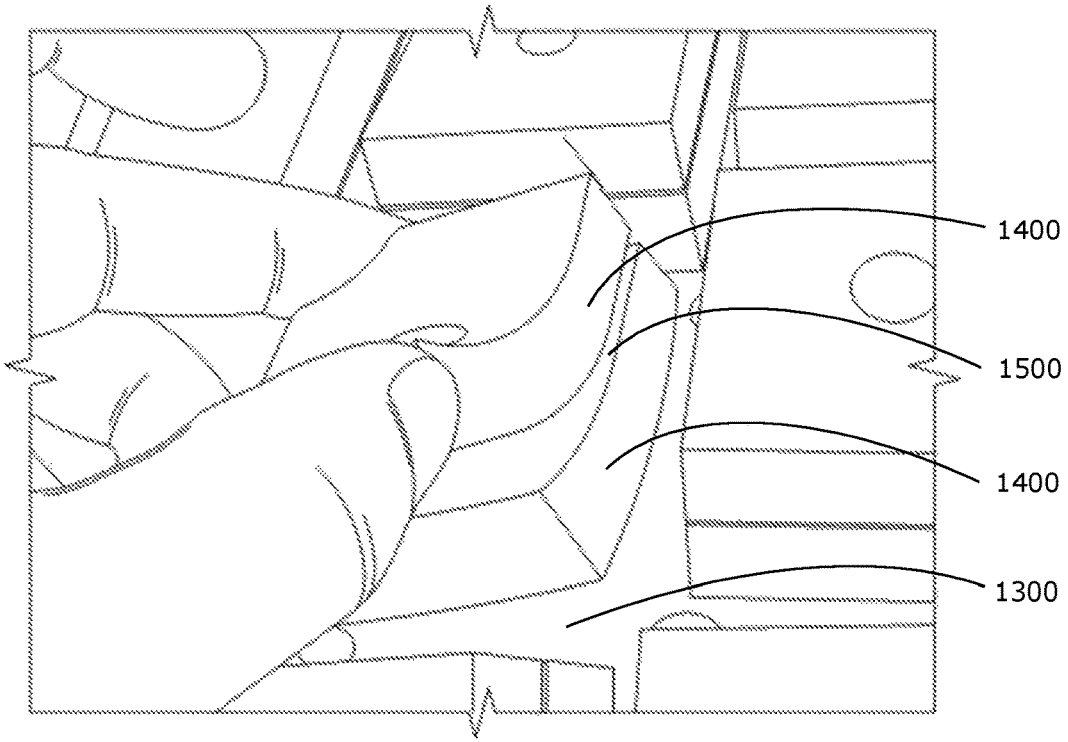
FIG. 6 is a close up view of the rear of the overlay of FIG. 4 where one removable contouring member is being torn away from the adjacent removable contouring member.
Figure 7:
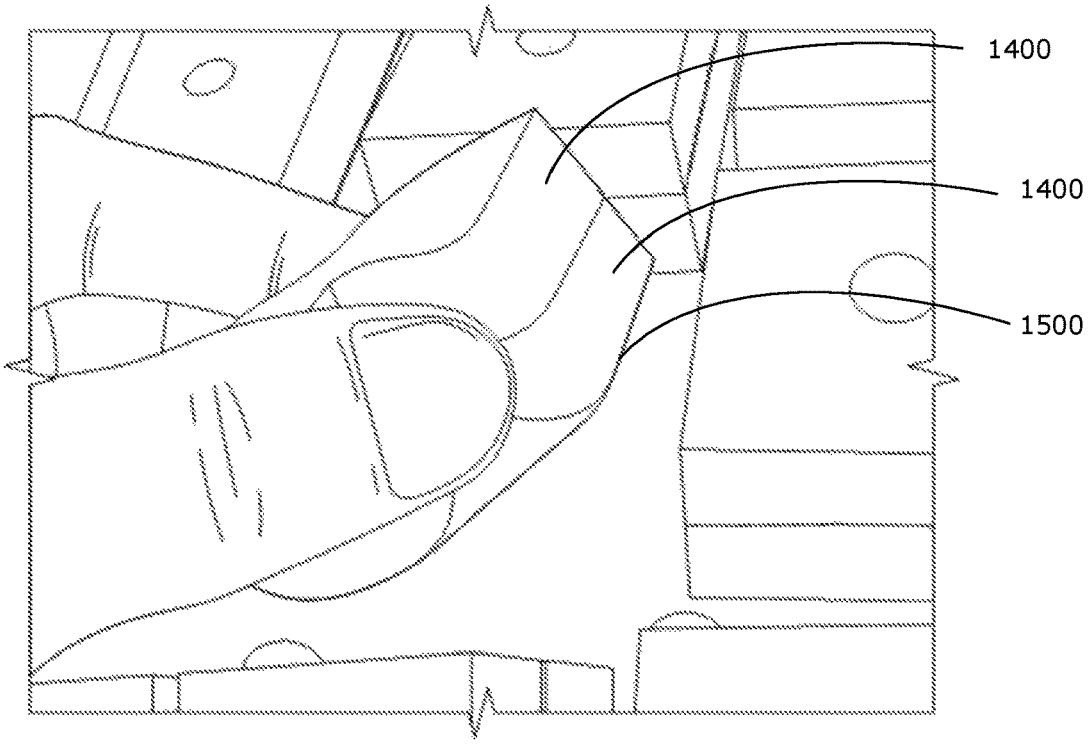
FIG. 7 is a close up view of the rear of the overlay of FIG. 4 where two contouring members are being torn away from the overlay.

In one form, the overlay 500 may comprise a plurality of apertures or breathing holes 1600 to support the breathability of the overlay 500. For example, breathing holes 1600 may be formed in the first layer 1000 and may extend through the main body of the first layer 1000 and through the removable contouring members 1400, as shown in FIGS. 5 to 11. Alternatively or additionally, breathing holes 1600 may extend through the body of the first layer 1000 and through the channels 1300 on the rear surface 1200 of the first layer 1000, as shown in FIGS. 3 and 5.

In one form, each removable contouring member 1400 comprises at least one breathing hole 1600. In some embodiments, each removable contouring member 1400 comprises a centrally located breathing hole 1600, as shown in FIGS. 3 to 10. The breathing holes 1600 of stacked removable contouring members 1400 are typically substantially aligned with each other.

The breathing holes 1600 may be circular holes, oblong slots, or of any other suitable shape to assist air circulation within the overlay 500.

Figure 12:
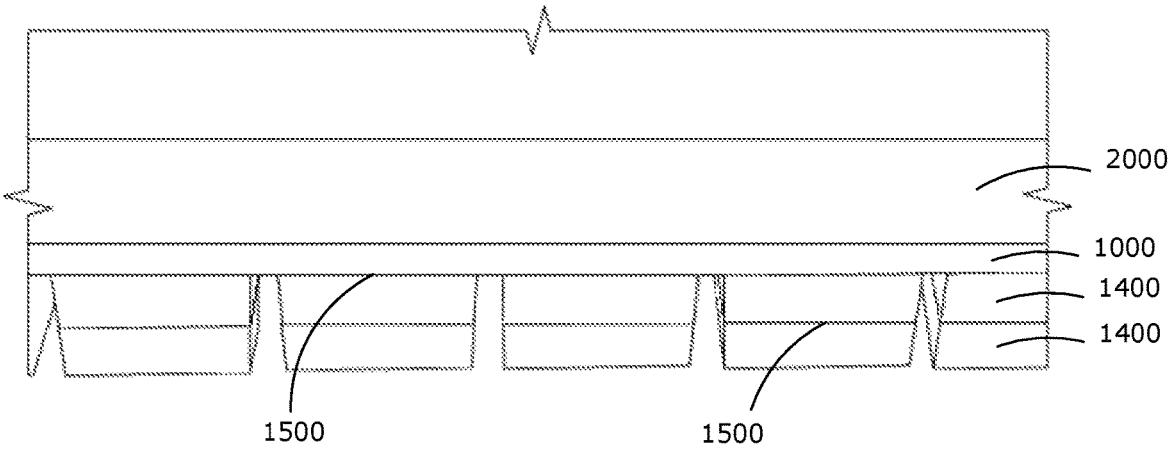
FIG. 12 is a close up side view of one form of overlay having first and second layers and also having separation lines between stacked removable contouring members and between contouring members and the body of the first layer.

The overlay 500 of the invention may be used as a single layer overlay, as described above, or the overlay 500 may comprise a flexible or semi-flexible second layer 2000 having a front surface 2100 and a rear surface 2200, as shown in FIG. 12. The second layer 2000 is attached to the front surface 1100 of the first layer 1000, as shown in FIG. 12. The second layer 2000 may be adhered, bonded, or otherwise attached to the first layer 1000 in any suitable manner that allows both layers 1000, 2000 to conform together around a contoured surface. For example, the rear surface 2200 of the second layer 2000 may be adhered, bonded or otherwise attached to the front surface 1100 of the first layer.

In one form, the second layer 2000 may be formed of a soft, cushioning, conforming material to provide comfort to the user. For example, the second layer 2000 may be a fabric layer, or may be a foam, silicone, or rubber layer or any flexible or semi-flexible and suitably soft, conforming layer of material. Where both the first and second layers 1000, 2000 of the overlay are formed of foam, different foams may be used such that one layer is of a different compressibility to the other layer. In a preferred form, both the first and second layers 1000, 2000 are formed of foam and the first layer 1000 is less compressible than the second layer 2000.

In one form, the overlay may include three or more layers, so that the second layer is sandwiched between the first layer and a third layer. One or more layers of the overlay may be formed of a different material to one or more of the other layers. Additionally or alternatively, one or more layers of the overlay may comprise different compressibility characteristics than one or more other layers.

In one form, one or more layers of the overlay may comprise areas of different material and/or different compressibility characteristics to one or more other layers of the overlay. For example, if the overlay is to be used in a seat backrest, it can be useful to configure the lower part of the overlay to stabilise the pelvis of the user. To assist with this stabilisation, in one form, at least one layer of the overlay, such as the first layer, may comprise a firm foam between a rear edge of the overlay and the sacral area of the overlay, which is the area that lies behind a user's sacrum during use. A softer, more compressible foam may then be used for the rest of the layer, such as from the area in front of the sacral area of the overlay to a front edge of the overlay. In another example, if the overlay is to be used as a mattress, at least one layer of the overlay, such as the first layer, may comprise a firmer material, such as a firm foam or other padding material, under the middle area of the mattress to provide support for the weight bearing area of the user's torso.

Figure 13:
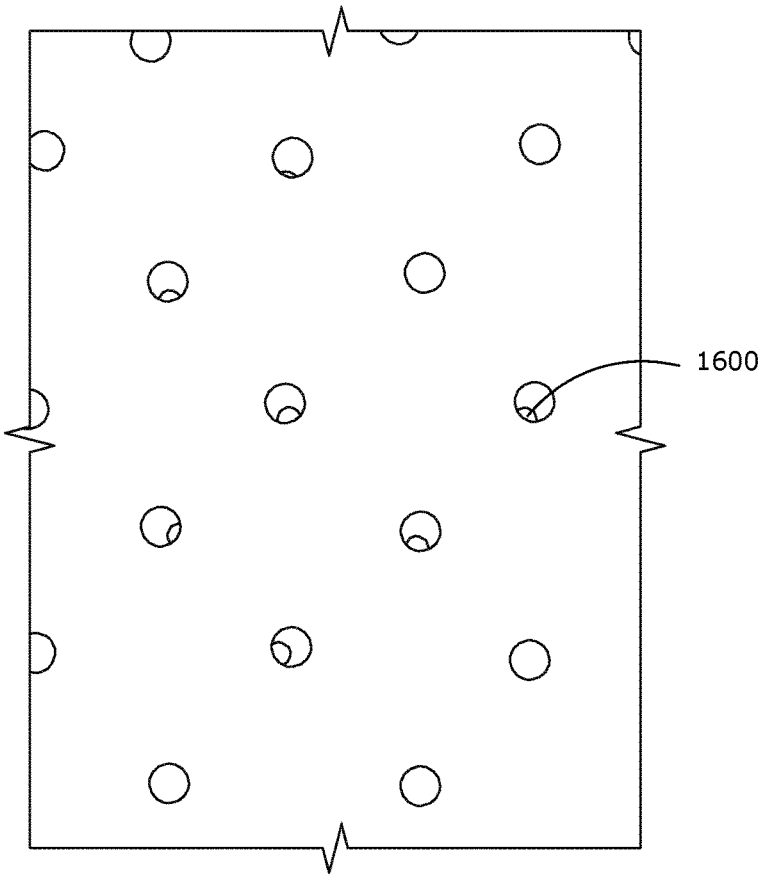
FIG. 13 is a close up view of FIG. 10*a*, showing the breathing holes of one form of overlay in substantial alignment with breathing holes of a wheelchair backrest.

The second layer 2000 may also include a plurality of apertures or breathing holes 1600 to support the breathability of the overlay 500. In one form, the breathing holes 1600 of the first 1000 and second 2000 layers are substantially aligned so that air can circulate freely between both the first and second layers 1000, 2000, as shown in FIG. 13.

Figure 14:
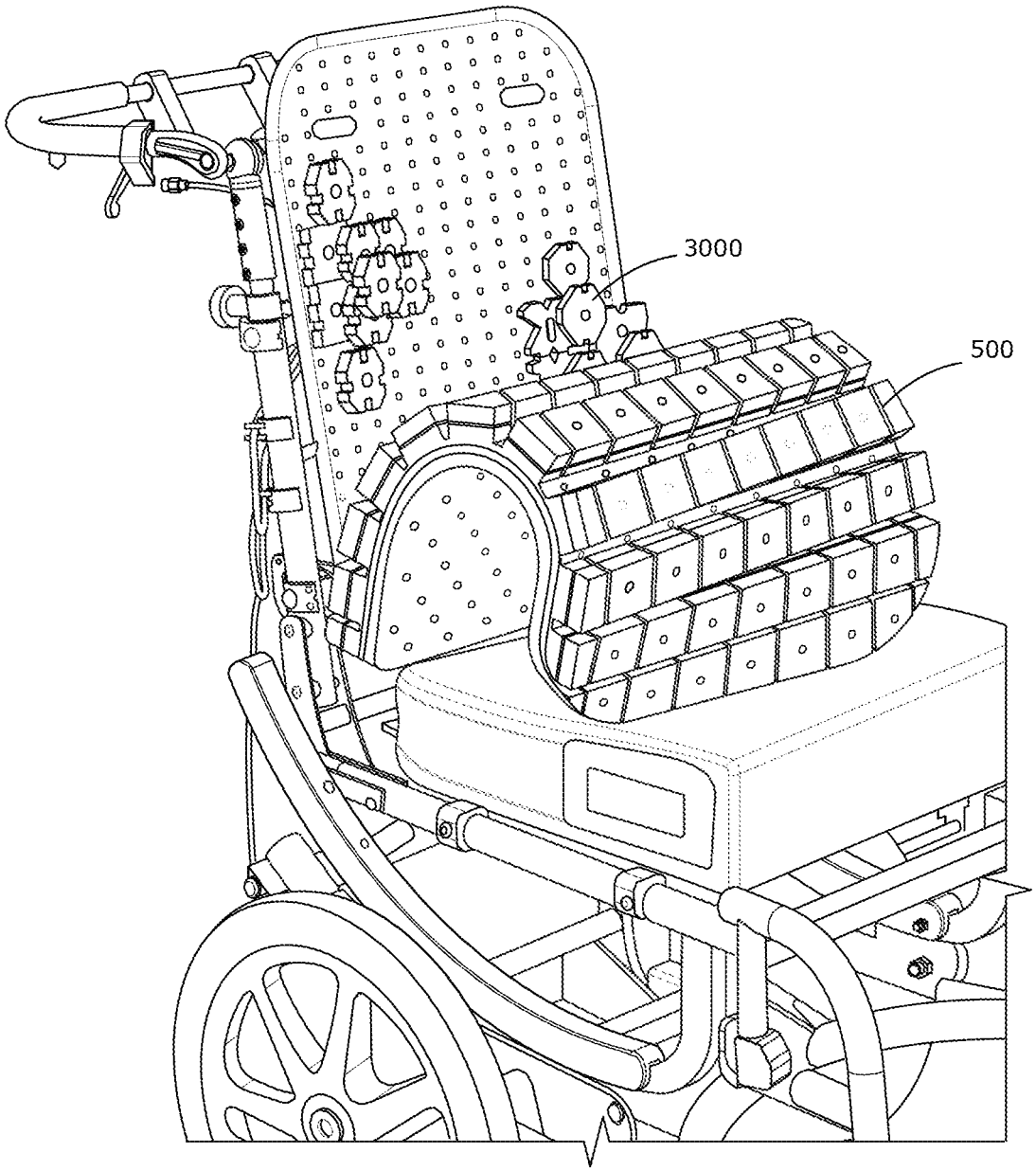
FIG. 14 is an isometric view of an overlay of one form of the invention before placement over a contoured backrest of a wheelchair.
Figure 15:
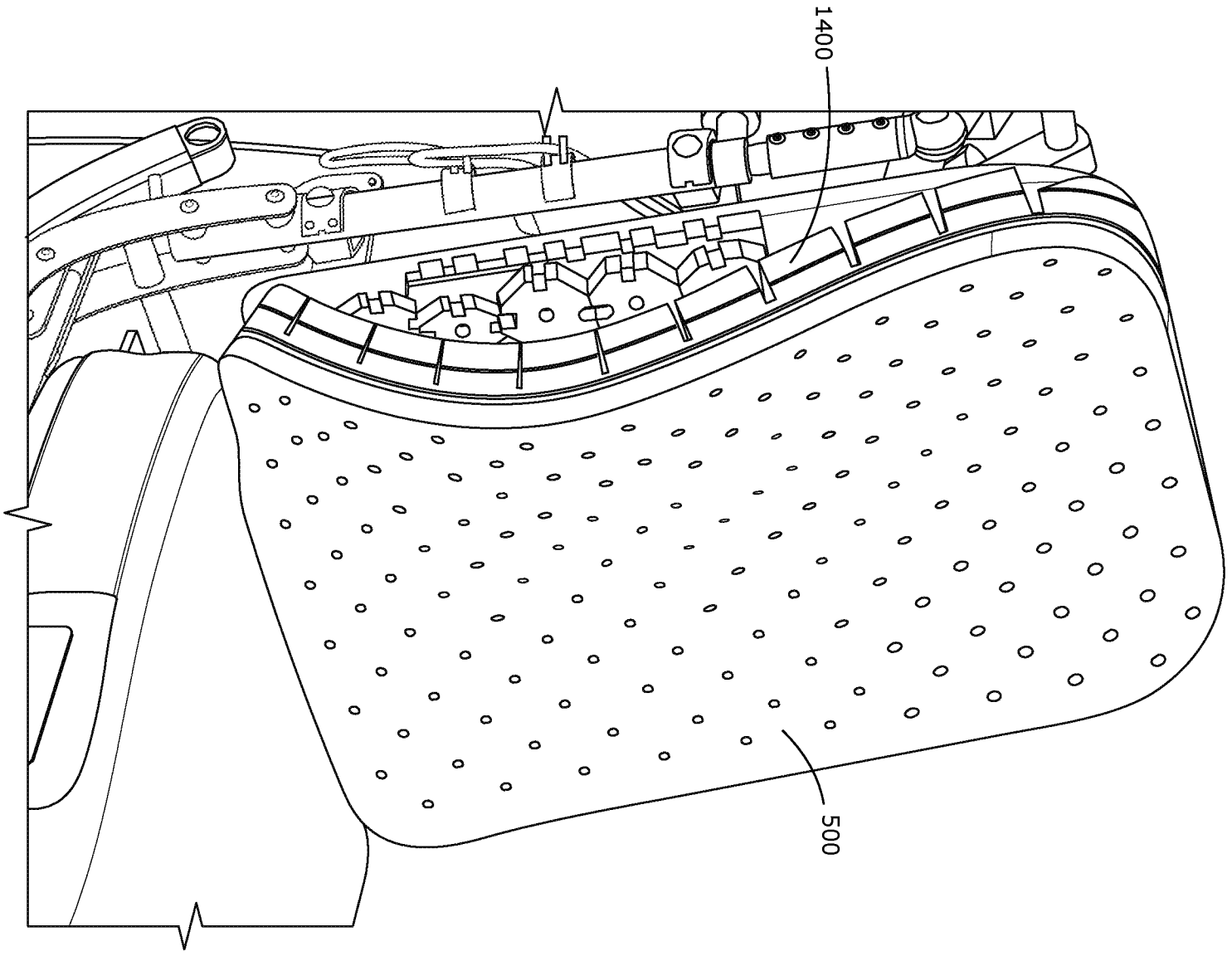
FIG. 15 is an isometric view of the overlay of FIG. 10 after it has been placed over a backrest having contouring on one side.
Figure 16:
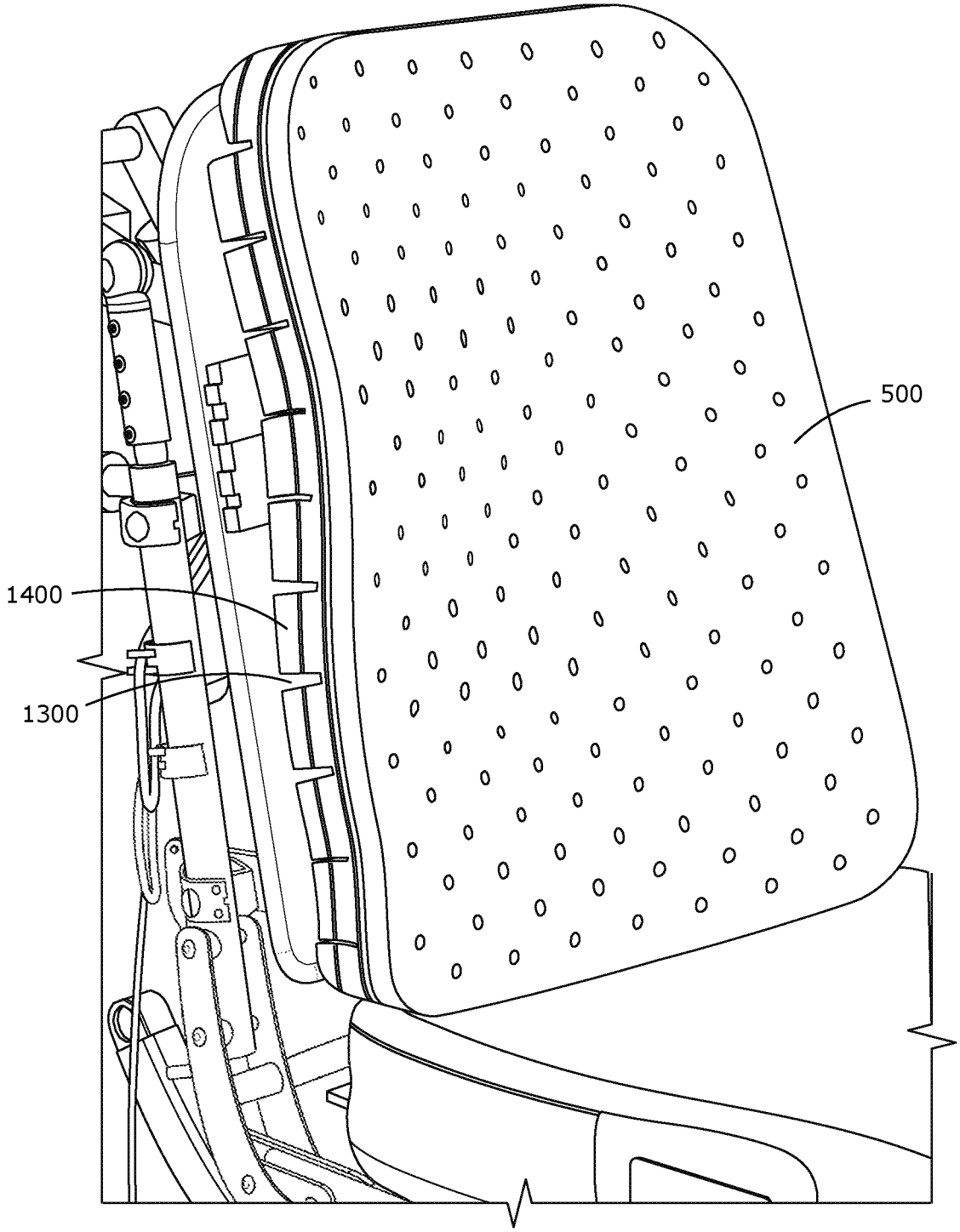
FIG. 16 is an isometric view of the overlay of FIG. 10 after it has been placed over a backrest having contouring on both sides.
Figure 17:
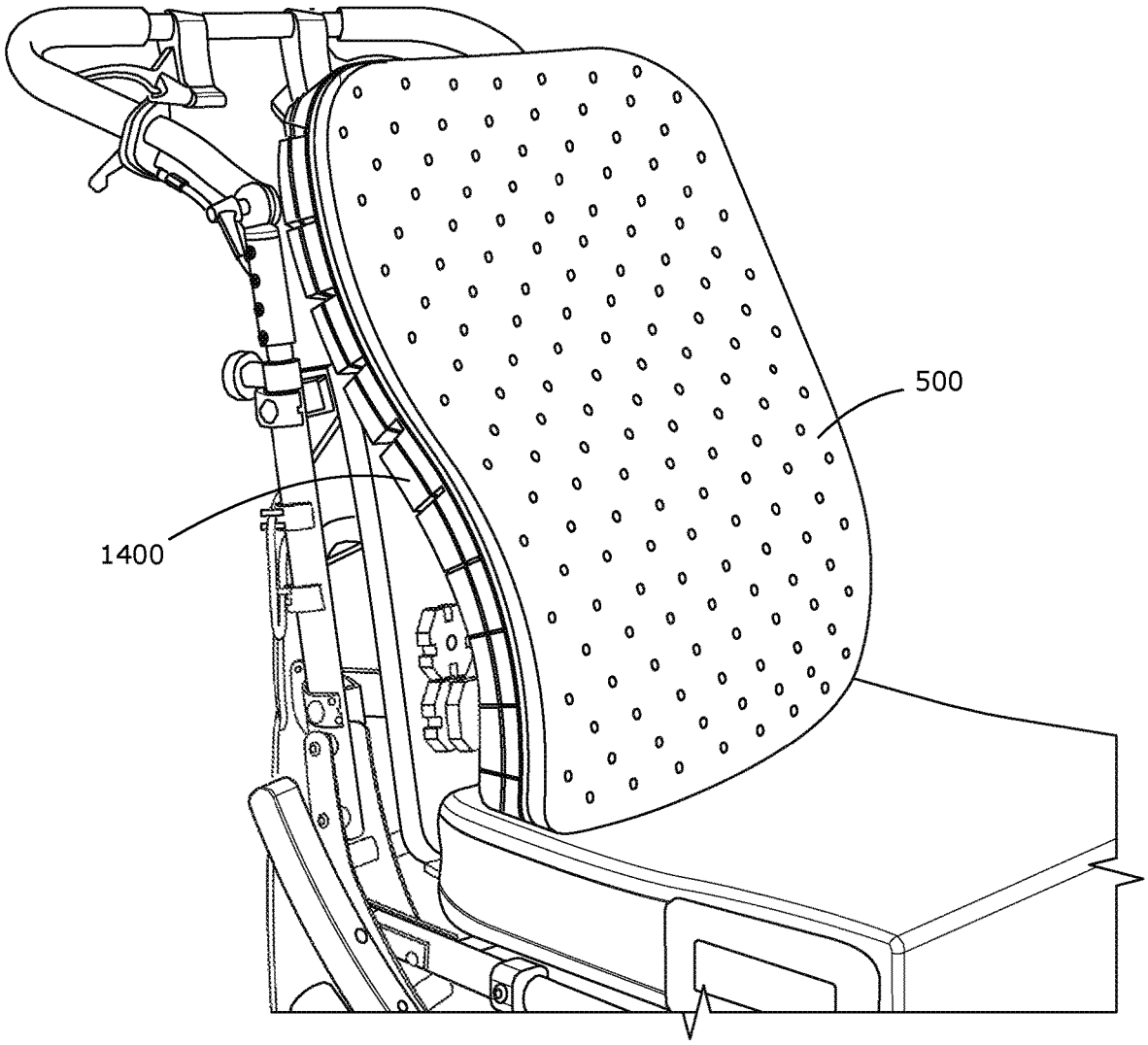
FIG. 17 is an isometric view of the overlay of FIG. 10 after it has been placed over a backrest having contouring in the lumbar region.

In one form, the overlay 500 comprises breathing holes 1600 that are positioned on the second layer 2000 and/or the first layer 1000 of the overlay 500 in a configuration that substantially corresponds to the configuration of breathing holes provided on a supporting surface, such as a mattress, wheelchair backrest, or other seat on which the overlay will be placed. For example, breathing holes 1600 in the form of circular holes may be provided on the overlay 500 and backrest in a substantially regular configuration and may preferably be spaced equidistant from each other to allow air to circulate freely between the overlay 500 and the seat, as shown in FIG. 14. In other forms, the breathing holes may be slots, triangular shapes, square shapes or of any other suitably shaped aperture. The breathing holes may be regularly or irregularly arranged on the overlay.

The overlay is configured to be used with a supporting surface, such as a mattress or a seat, such as a wheelchair seat base or backrest, a dining chair, lounge chair, a car seat, an aircraft seat, or any other seat or article for which contoured cushioning is required In use, the overlay 500 is positioned over a supporting surface 3000 so that the rear surface 1200 of the first layer 1000 faces toward the supporting surface 3000. Typically, but not necessarily, the supporting surface 3000 is contoured by being configured to include raised areas and/or recessed areas to support the posture and/or alignment of the user, as shown in FIGS. 13 to 17. The supporting surface 3000 may be a cushioned surface or a rigid surface.

An overlay 500 to be used with a rigid supporting surface preferably comprises a cushioning material, such as foam, rubber, or silicone. Preferably, the cushioning material is provided on the front surface of the overlay as it is this surface that is likely to be contacted by a user during use.

As the overlay 500 is placed on the contoured supporting surface 3000, as shown in FIGS. 13 to 17, the channels 1300 allow the overlay 500 to flex around the contours of the supporting surface and to substantially mold to the shape of the contoured surface 3000. The resulting contours in the overlay 500 may be reduced or increased in extent by removing one or more removable contouring members 1400 from the rear surface 1200 of the overlay 500. In this way, the overlay 500 can provide a soft and contoured surface to satisfy the postural and/or alignment needs of the user.

Advantages of the Invention

The overlay of the present invention can be used to support and/or to provide customised contoured cushioning to meet the needs of individual users. In particular, the configuration of the channels on the rear surface of the overlay allows the overlay to readily adapt to the contours of the supporting surface with which the overlay will be used.

The configuration of the channels also allows for greater control over the extent to which the overlay compresses in different areas. In effect, the channels act to substantially isolate each removable contouring member from adjacent contouring members. This means that it is possible to compress areas of the overlay without creating significant amounts of sink in adjacent areas. The channels also act to substantially break up the otherwise continuous surface of the overlay to provide greater conformity and comfort.

It is also possible to alter the contouring effect of the overlay by removing one or more of the removable contouring members from the rear surface of the overlay.

In some embodiments, the breathing holes formed in the overlay allow for improved breathability, so that a user of the overlay is less likely to become hot and sweaty or retain moisture on the areas of the user's body that contact the overlay.

The breathing holes formed in the overlay also reduce the weight of the overlay, which is useful for people that are carrying the overlay or a mattress or seat, such as wheelchair, that bears the overlay. In addition, the breathing holes help the overlay to compress and readily mould around the contours beneath or behind the overlay to provide greater comfort to the user.

Although the invention has been described by way of example, it should be appreciated that variations and modifications may be made without departing from the scope of the invention as defined in the claims. Furthermore, where known equivalents exist to specific features, such equivalents are incorporated as if specifically referred in this specification.

I claim:

1. A seat comprising a backrest comprising a contoured surface formed from a plurality of stackable contouring units that form raised areas and/or recessed areas, wherein the seat further comprises a flexible, customisable backrest overlay that substantially conforms around the contoured surface of the backrest, and that comprises a first layer having a front surface and a rear surface, wherein a plurality of channels are provided on the rear surface and extend in a first direction along the rear surface to allow the overlay to flex around the contoured surface of the backrest, wherein one or more first contouring members are located between adjacent channels and project from the rear surface of the first layer and wherein one or more second contouring members are located between adjacent channels and are attached to the one or more first contouring members so that the first and second contouring members form stacks of contouring members between adjacent channels, and wherein perforation lines are provided between the stacked contouring members to allow each second contouring member to be detached from the first contouring member in the same stack to adjust the contours of the front surface to provide customized contoured cushioning to satisfy the postural alignment needs of the user.

2. The overlay of claim 1, wherein the rear surface of the first layer further comprises a plurality of channels extending in a second direction along the rear surface, the second direction being generally orthogonal to the first direction to provide removable contouring members in a grid-like arrangement.

3. The overlay of claim 1, wherein the first layer and the first contouring members, are formed as a single part.

4. The overlay of claim 1, wherein the first layer is formed of foam.

5. The overlay of claim 1, wherein perforation lines are provided between the first contouring members and the rear surface of the first layer to allow the first contouring members to be detached from the first layer.

6. The overlay of claim 1 and further comprising a second layer attached to the front surface of the first layer and wherein the second layer is formed of a different material to the first layer.

7. The overlay of claim 6, wherein the first and second layers are both foam layers and wherein the first layer has different compressibility characteristics to the second layer.

8. The overlay of claim 6, wherein the second layer comprises one or more areas having different compressibility characteristics to one or more other areas of the second layer.

9. The overlay of claim 6, wherein both the first and second layers comprise a plurality of generally aligned breathing holes extending between the first and second layers.

10. The overlay of claim 9, wherein the generally aligned breathing holes are provided in a regular arrangement to correspond with a regular arrangement of breathing holes provided on a backrest of a seat against which the overlay will be positioned.

11. The overlay of claim 1, wherein the first layer comprises one or more areas having different compressibility characteristics to one or more other areas of the first layer.

12. The overlay of claim 1 wherein at least the first layer comprises a plurality of breathing holes for breathability.

13. The overlay of claim 12, wherein at least one breathing hole extends through at least one stack of first and second contouring member provided on the rear surface of the first layer of the overlay.

* * * * *